US006547528B1

(12) United States Patent
Yoshida

(10) Patent No.: US 6,547,528 B1
(45) Date of Patent: Apr. 15, 2003

(54) CONTROL SYSTEM FOR FIRE PUMP

(75) Inventor: Kenichi Yoshida, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 24 days.

(21) Appl. No.: 09/712,523

(22) Filed: Nov. 14, 2000

(30) Foreign Application Priority Data

Mar. 30, 1999 (JP) ..... 11-087669
Nov. 29, 1999 (JP) ..... 11-337961

(51) Int. Cl.[7] ..... F04B 49/00; F04B 49/10
(52) U.S. Cl. ..... 417/34; 417/13; 417/18
(58) Field of Search ..... 417/34, 32, 18, 417/22, 13

(56) References Cited

U.S. PATENT DOCUMENTS 4,189,005 A * 2/1980 McLoughlin ..... 169/24
4,611,290 A * 9/1986 Henningsen et al. ..... 364/510
5,319,641 A * 6/1994 Fridrich et al. ..... 370/447
5,706,274 A * 1/1998 Angelico et al. ..... 370/85.3
5,765,995 A * 6/1998 Springer ..... 417/40
5,941,418 A * 8/1999 Box et al. ..... 222/71
6,273,771 B1 * 8/2001 Buckley et al. ..... 440/84

FOREIGN PATENT DOCUMENTS

GB 0868929 * 7/1998
JP 5137809 6/1993

* cited by examiner

*Primary Examiner*—Cheryl J. Tyler
*Assistant Examiner*—Michael K. Gray
(74) *Attorney, Agent, or Firm*—Martin A. Farber

(57) ABSTRACT

A system for remote-controlling a fire pump with a simple wiring construction is provided, being capable of conducting various kinds of control and display. The fire pump control system has an engine, a fire pump, an internal control apparatus, at least one external control apparatus located away from the fire pump including the internal control apparatus, and a twisted pair line for connecting the external control apparatus with the internal control apparatus. The internal and external control apparatuses form a network through the twisted pair line so as to control the fire pump through telecommunications from the external control apparatus. This network uses a p-CSMA system for communicating data, so that a high level of remote control can be carried out, with monitoring an operation state of the fire pump.

4 Claims, 5 Drawing Sheets

Fig.4
| ERROR CODE | ABNORMAL CONTENTS |
|---|---|
| Err.1 | FIRE-FLOW PRESSURE SENSOR |
| Err.2 | FIRE-FLOW DISCHARGE RATE SENSOR |
| Err.3 | WATER ABSORPTION PRESSURE SENSOR |
| Err.4 | START-UP FUNCTION |
| Err.5 | ABSORPTION AND DISCHARGE FUNCTION |
| Err.6 | ENGINE STOP |
| Err.7 | OTHER ABNORMALITIES |
Fig.5A
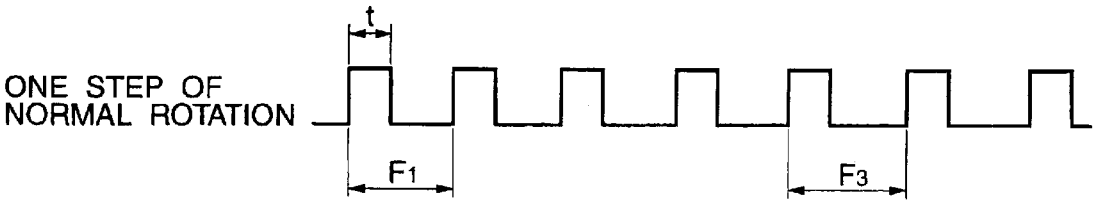
Fig.5B
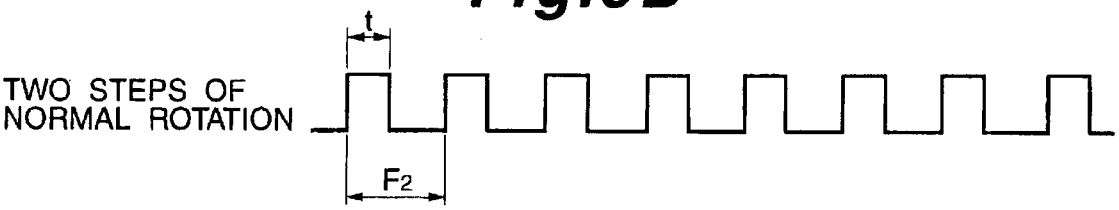

CONTROL SYSTEM FOR FIRE PUMP

BACKGROUND OF THE INVENTION

The present invention relates to a system for controlling a fire pump, wherein a network is formed by both a fire pump body and a controller which is located away therefrom and can control the fire pump body by means of telecommunication.

Conventionally, there has been proposed a remote control system of a fire pump in a portable fire pump which can operate the fire pump even with a long distance interval as, for example, disclosed in Japanese Patent Application Laid Open No. 5-137809. Such a remote control system has an advantage that a fireman can remote-control the fire pump even when the fireman stays away from the fire pump for fire fighting. Thus, even under the condition that the communication between the fireman and an operator of the fire pump is difficult to be maintained, a water discharging work can be carried out corresponding to the situation of the fire spot, so that an efficiency of fire fighting can be accomplished.

However, in such a remote control system, only one system can be mounted to one fire pump, or even if a plurality of systems can be mounted thereon, a wiring of data line for each remote control system must be installed so as to connect with the fire pump, respectively. As a result, there occurred a problem that the wiring becomes complicated.

Also, the conventional remote control system to be connected was under the relatively low level in which the on/off operation of the fire pump can be controlled. In the other words, it was impossible to conduct a complicate and fine control from the side of the remote control system. In addition, at the side of the remote control system, an operator can not know the present situation of the fire pump. For an adequate fire fighting, an improvement of these points have been expected.

SUMMARY OF THE INVENTION

An object of the present invention is to provide a system for remote-controlling a fire pump with a simple wiring construction, being capable of conducting various kinds of control and display.

According to the first aspect of the present invention, there is provided a fire pump control system having an engine, a fire pump, and an internal control apparatus, comprising at least one external control apparatus located away from the fire pump including the internal control apparatus, and a twisted pair line for connecting the external control apparatus with the internal control apparatus, wherein the internal and external control apparatuses form a network through the twisted pair line so as to control the fire pump through telecommunications from the external control apparatus.

According to such a construction, the network is formed through a simple wiring which uses the twisted pair line. On the network, an operator can control the fire pump with communication from the external control apparatus. As a result, a high level of remote control to the fire pump through a plurality of controllers can be realized. Therefore, the operator can remote-control the fire pump from a remote place with monitoring an operation state thereof, so that more appropriate fire fighting can be expected.

According to the second aspect of the present invention, the fire pump control system is characterized in that the internal control system at least has a control circuit comprising a motion control circuit for receiving information from various kinds of sensor mounted on the fire pump and transmitting control signals to an engine actuator, and a communication control circuit for communicating with the external control apparatus through the twisted pair line, and has an operation display section comprising an operation display panel and a throttle operation key.

According to the third aspect of the present invention, the fire pump control system is characterized in that the external control apparatus at least has an operation display portion comprising the operation display panel and the throttle operation key, and a control circuit including a communication control circuit for communicating with the internal control apparatus through the twisted pair line.

According to the fourth aspect of the present invention, the fire pump control system is characterized in that the network uses a p-CSMA system for communicating data. Thereby, a collision rate of data on the network can be restrained lowly.

BRIEF DESCRIPTION OF THE DRAWINGS

These and other objects and advantages of the present invention will become clear from the following description with reference to the accompanying drawings, wherein:

FIG. 4 is a table showing one example of error codes;

FIG. 5 is an explanatory view showing one example of pulse voltage applied to a control of a throttle drive motor.

DETAILED DESCRIPTION OF THE PREFERRED EMBODIMENT

Figure 1:
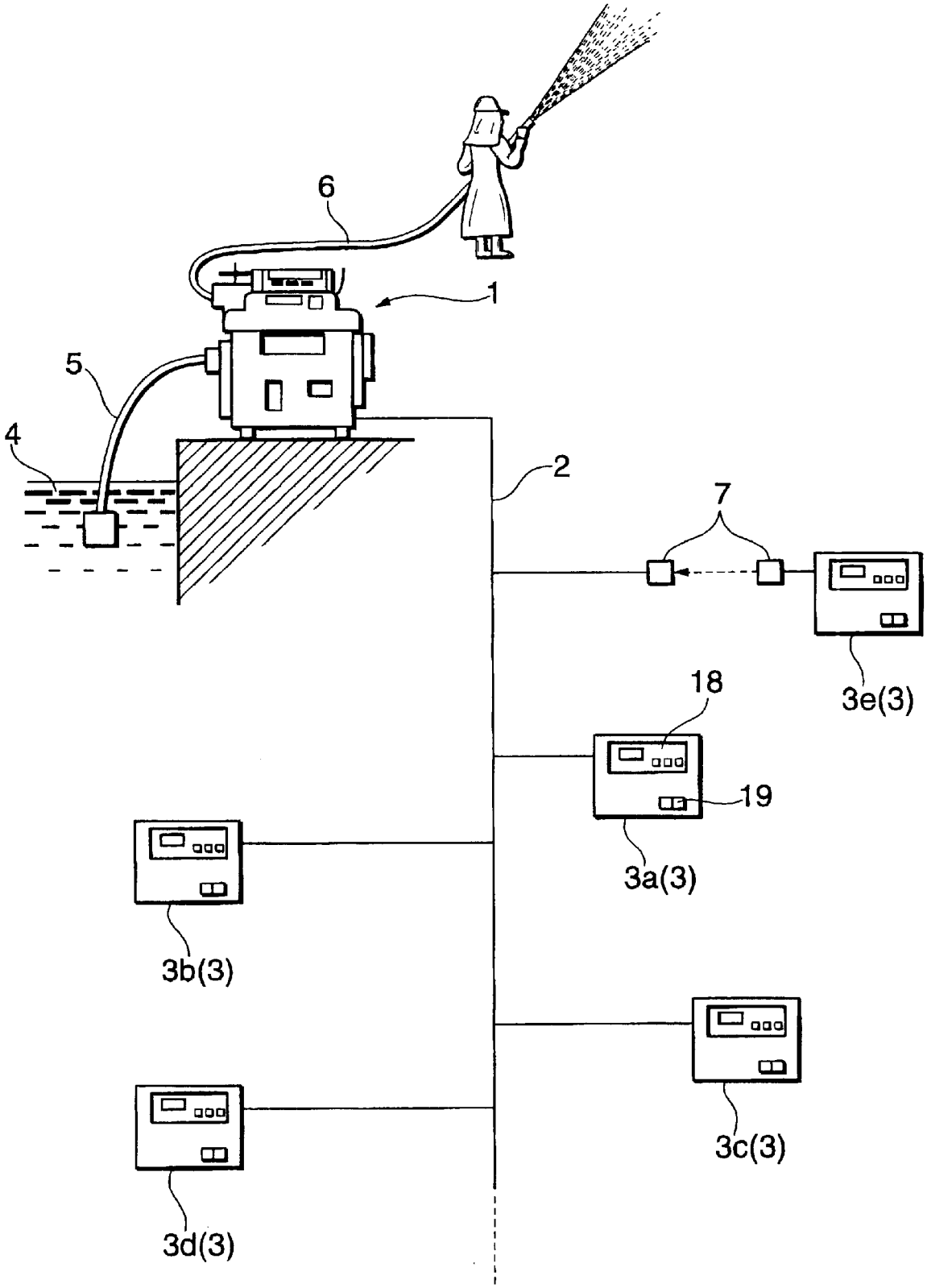
FIG. 1 is an explanatory view showing a whole construction of a fire pump control system according to one embodiment of the present invention.

As shown in FIG. 1, a fire pump control system of the present invention forms a network in which a fire pump 1 is connected to controllers 3(3*a*–3*e*) through a twisted pair line 2 so that the fire pump 1 can be remote-controlled by the controllers 3. FIG. 1 shows an example using a portable fire pump as a main pump. The fire pump 1 is provided with a water-cooled two cycle engine and a vacuum pump driven thereby. The fire pump 1 draws water from a water source 4 through a suction pipe 5, adjusts a flow rate and a water pressure thereof, and supplies water to a fire hose 6.

Figure 2:
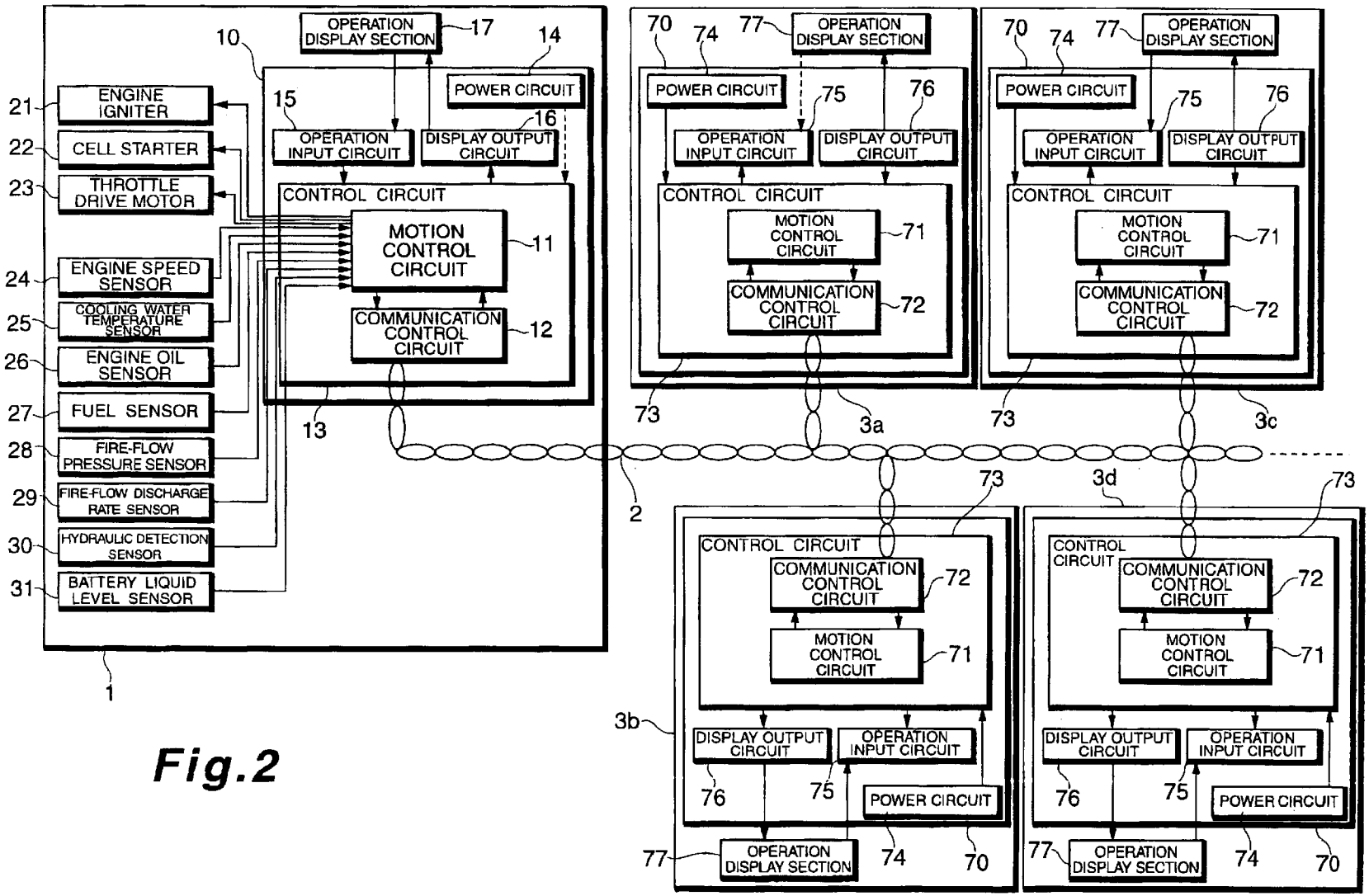
FIG. 2 is an explanatory view showing a construction of controllers of the system in FIG. 1.

As shown in FIG. 2, the pump 1 is controlled by a main control portion 10 comprising a microcomputer as accommodated therein. The main control portion 10 includes a control circuit 13 having a motion control circuit 11 and a communication control circuit 12. In this case, the motion control circuit 11 and the communication control circuit 12 are provided with a CPU, ROM, RAM, timer, input/output portion, A/D converter and the like, respectively, so that they can control an engine based on data detected from various kinds of sensors.

The motion control circuit 11 is connected to an engine igniter 21, various kinds of actuators such as a cell starter 22 and a throttle drive motor 23, and various kinds of sensors such as an engine speed sensor 24, an engine cooling water temperature sensor 25, an engine oil sensor 26, a fuel sensor 27, a fire-flow pressure sensor 28, a fire-flow discharge rate sensor 29, a water pressure detection sensor 30, and battery liquid level sensor 31. Moreover, the water pressure detection sensor 30 is used in a mode of relay water supply, which is for automatically carrying out a start operation of engine, a throttle control, and stop operation thereof through detecting a pressure of water supplied from a previous pump.

Figure 3:
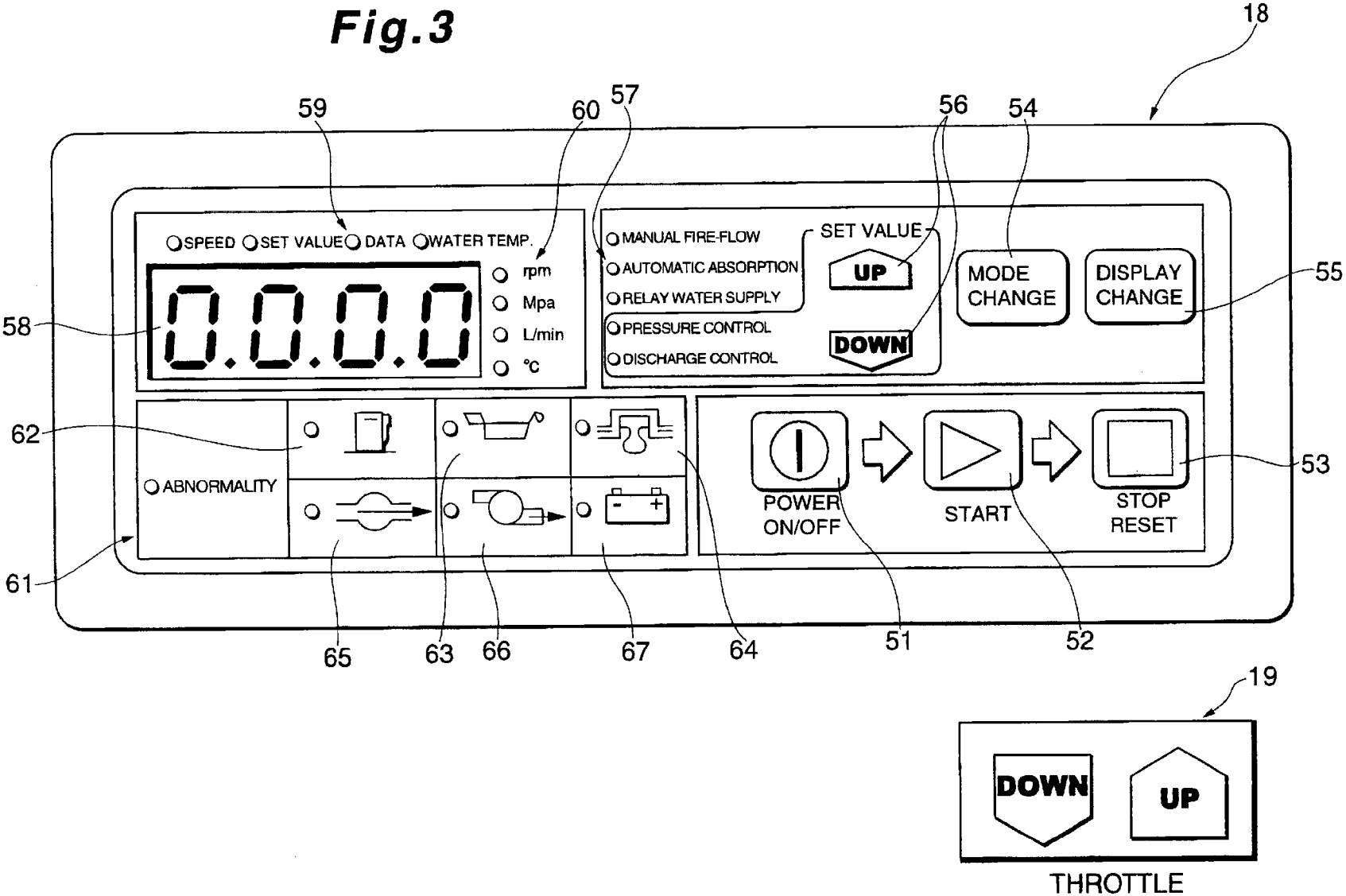
FIG. 3 is an explanatory view showing a construction of an operation display section.

Further, the motion control circuit 11 is always monitoring the sensor devices during turning-on of the power source, because a breakdown of the fire pump is difficult to be found out in advance since it is not an apparatus which is often used, and further it is required to correspond with the breakdown during the activation at once, if any. Therefore, a diagnostic operation starts at the same time with the turning-on of the power, and carries out an error operation, determining that an error is occurring in the case that an output value of sensor is over or below a predetermined level. That is, an error indication is displayed on an operation display panel 18 as shown in FIG. 3, so that an operator can know an error occurrence at once during the turning-on. If the error is severe, an operation of engine is stopped so as to prevent the disorder from expanding.

Further, the motion control circuit 11 automatically carries out zero resetting of the water pressure detection sensor 30, because there occurs a margin of error in a sensor detection value due to an air pressure in the case that a position of the water source is higher than that of the fire pump, e.g. roof water supply. This amendment leads an accurate activation of the water pressure detection sensor 30. The amending operation is carried out through pressing a power source key 51 on the operation display panel 18. Sensor detection values before and after amending are stored in the RAM of the motion control circuit 11. Therefore, the zero resetting of sensors is automatically carried out when turning-on the pump 1, and further an operator can carry out the zero resetting also through pressing the power source key 51 at a desired timing.

The main control portion 10 further has a power circuit 14 connected with a battery for supplying a power to the control circuit 13, an operation input circuit 15 for receiving an instruction from the operation display section 17, and a display output circuit 16 for outputting a present various kinds of data of the fire pump 1 corresponding to the request of the operator at the operation display section 17. The operation display section 17 includes an operation display panel 18 and a throttle operation key 19, which are located on an upper face of the fire pump 1.

On the operation display panel 18, various kinds of changeover key and display portion are provided. The operating portion is located at the right side on the operation display panel 18, the displaying portion being located at the left side, because most of the operators usually use their right hands when operating. Namely, on the right lower portion of the panel 18 are arranged a power changeover key 51, an engine start key 52, and an engine stop/reset key 53, and also on the upper right portion thereof are arranged an operation mode changeover key 54, a display changeover key 55, and a set value change key 56.

When these keys are pressed, a sharp operating sound such as a whistle is generated to ensure the operator to clearly realize that the operation with regard to changeover of the mode was received by the system. In addition, an engine stop/reset key 53 can not turn on/off the power unless the key is continuously pressed for t seconds (for example, 3 seconds), in order that the power is prevented from being inadvertently turned on/off by an accidental operational error through an unexpected touching or the like.

At the left side of the upper right portion's keys, mode display lamps 57 are arranged for displaying the present operation mode. Each time the operation mode changeover key 54 is pressed, the operation mode is changed over in the sequence of "manual fire-flow", "automatic absorption", "relay water supply", "pressure control", "flow control", and "manual fire-flow" again. According to the changeover, the mode display lamp 57 sequentially lights the portion of the related mode. The mode of "manual fire-flow" is a manual operation during all the courses from start to discharge, whereas the mode of "automatic absorption" is automatically carried out until absorbing water, but after then a manual operation. The mode of "relay water supply" is to relay-supply water from a previous pump to a following pump. Also, each mode of "pressure control" and "flow control" is completely an automatic mode between start and discharge.

When changing over the operation mode in the operation display section 17, a delay time is set between a mode changeover timing and a mode definition timing so as not to decide the mode at the same time as the mode changeover timing. The reason why setting the delay time is that if every pressing the operation mode changeover key 57 leads a changing effect of mode at once, i.e. the definition of mode, there is any fear that the mode after the "relay water supply" mode can not be changed in the case that an input water pressure over a predetermined value is detected at the hydraulic detection sensor 30.

In the other words, in the mode of "relay water supply", when the input water pressure reaches the predetermined value, it is set to automatically start the engine so as to start the "relay water supply". For example, in the cases that water is being supplied from the previous pump or the roof water source, the input water pressure may become over a start pressure due to a condition change after that in spite of the aforementioned zero resetting function. Under this situation, there may occur a problem that even if an operator intends to changeover the operation mode, for example, from the "automatic absorption" mode to the "pressure control" mode, the mode can not move to the "pressure control" mode, because at the instant when the mode moves to the "relay water supply" mode through pressing the operation mode changeover key 54, the engine starts and then the "relay water supply" mode is fixed to be started.

In addition, once the "relay water supply" mode is activated, even if the power source is changed over off, an operation from the "relay water supply" mode is restarted when turning-on the power again because the system records the mode just before changeover to off. Therefore, even if the power source is changed over to off in order to stop the mode of "relay water supply", after all the same mode, i.e. "relay water supply" mode is activated, and it can not move to the next mode.

Then, the fire pump 1 is provided with a delay time between the mode change and the mode definition so as not to decide the mode at once even if the operation mode changeover key 54 is pressed, so that the "relay water supply" mode is prevented from being inadvertently fixed. Namely, when the operation mode changeover key 54 is pressed to move to the next mode, the mode is not decided for t seconds (for example, three seconds). When the operation is in the delay time, the situation is represented by flashing the mode display lamp 57. When the mode is decided after t seconds have passed, the mode display lamp 57 is lighted on to start an action of the mode. Thus, even in the case that the input water pressure higher than a start pressure is applied, the operation mode is prevented from being fixed. Therefore, the selection of mode can be freely carried out.

On the upper left portion of the operation display panel 18, a numerical value display portion 58 having a seven segments display is located. On the upper portion of the numerical value display portion 58, a numerical value attribute indicating portion 59 is located for indicating an attribute of the value shown therein, and a unit indicating portion 60 for indicating a unit of the numerical value is arranged on the right side thereof. At every pressing the display changeover key 55, the display mode is changed in such a sequence as "engine speed", "set value of fire-flow pressure or flow", "measured data of the fire-flow pressure or the flow", "engine cooling water temperature", and "engine speed" again. Along with these changes, the corresponding mode's portion is lighted in the numerical value attribute indicating portion 59 and the unit indicating portion 60 also.

In such a way, the operator can easily know the engine speed, engine cooling water temperature, and flow through just changing over keys of the pump 1. Conventionally, these information could not be obtained by the operator positioned far from a main fire pump. Further, although, conventionally, the fire-flow pressure was measured by a pressure gauge, according to the present invention, it can be measured through reading the digital display. Therefore, it is not at all necessary to read a pointer of the pressure gauge. This means that the operator can obtain much and exact information in respect of the present situation of the pump 1, so that a more exact operation can be accomplished.

Further, the numerical value display portion 58 can display not only numerical value data, but also various kinds of message. For example, when a throttle opening degree is increased through a throttle operation key 19 and then the throttle is all opened, the message "FULL" is displayed thereon. Also, a plasma display may be used in stead of the seven segments display for the numerical value display portion 58, wherein the message "START", "STOP" or the like can be displayed when the engine start key 52 and the engine stop/reset key 53 are pressed, respectively. Further, when carrying out the above-mentioned zero resetting operation, the message "0(ZERO)SET" is displayed. When returning an initial situation, the message "INIT" is displayed.

In addition, the numerical value display portion 58 displays an error code such as "Err.1" when the motion control circuit 11 detects an error in a diagnosis of sensor abnormality. FIG. 4 is a table showing an example of error codes. For example, the code of "Err.1" indicates that there occurred a breakdown in a fire-flow pressure sensor 28. Moreover, a cancellation of the error display is carried out by the engine stop key 53. Also, a warning buzzer or the like may be used as well as the error display.

At the lower left portion of the operation display panel 18 is located an abnormality warning display portion 61, which has a fuel warning lamp 62 lighted when the remainder of fuel becomes below a predetermined value, an engine oil warning lamp 63 lighted when the remainder of engine oil becomes below a predetermined value, and an engine cooling water temperature warning lamp 64 lighted when the temperature of cooling water becomes over a predetermined value as warning lamps for the engine. Further, the abnormality warning display portion 61 has a drain cock warning lamp 65 lighted when a drain cock for discharging fuel during keeping for a long time is opened, a vacuum pump operation warning lamp 66 lighted when the vacuum pump is operated, and a battery liquid level warning lamp 67 lighted when the battery liquid level lowers below a predetermined position.

At the lower portion of the operation display panel 18, a throttle operation key 19 is provided, which allows a throttle valve to be opened/closed. In the pump 1 of the present invention, the throttle valve is opened/closed by a throttle drive motor 23 comprising a DC motor, and controlled by the motion control circuit 11.

Although the conventional fire pump also could open/close the throttle valve of engine using the motor, the control therein was limited to the ON/OFF control of motor without a delicate valve opening adjustment. In order to carry out an automatic control of the fire-flow pressure or the discharge flow, however, the delicate throttle adjustment is required. In the conventional, simple ON/OFF control, there occurs a hunting, so that it is difficult to obtain a constant output power. When carrying out the "relation water supply", it is requested to finely adjust the fire-flow pressure corresponding to the water pressure from the previous pump. However, the conventional ON/OFF control can not lead such a delicate follow-up control.

Then, the pump 1 of the present invention is provided with a speed control function comprising a plurality of steps applied to the throttle drive motor 23, which accomplishes a fine adjustment of opening degree. Namely, a pulse voltage as shown in FIG. 5 is applied to the throttle drive motor 23, in which according to a duty rate of ON time or OFF time, for example, the speed control comprising all the 16 steps of 7 steps of normal rotation, 8 steps of reverse rotation, and 1 step of no rotation is carried out. FIGS. 5A and 5B are explanatory views showing an example of the pulse voltage which is applied to the control of the throttle drive motor 23.

In this control operation, a duty frame F (a length of one cycle of pulse) of the pulse voltage can be freely set every control step. In FIGS. 5A and 5B, the duty frame of the two steps of normal rotation is set in smaller length than that of the one step of normal rotation (F1>F2). In addition, the duty frame F can be voluntarily set in each control step also, and so the duty frame F after a motor start timing may be changed from one of the motor start timing. In the one step of normal rotation as shown in FIG. 5A, the duty frame F at the motor start timing is set in small length, and then gradually increased (F1<F3).

In other words, the control operation of the present invention can freely change the duty rate through changing the duty frame F even if all the ON time t of each control step is identically set. Therefore, once one ON time t is set, a rotation control can be realized step by step, an adjustment of which also can be easily carried out.

Moreover, the speed may be controlled step by step through changing the period of ON time t, not the length of the duty frame F. In short, the motor speed of the two steps of normal rotation can be set more highly than that of the one step of normal rotation through setting a longer ON time t of the two steps of normal rotation than that of the one step of normal rotation. In addition, the length of the both duty frame F and ON time t may be voluntarily set, respectively, so that a broader control can be carried out.

In such a way, the pump 1 can voluntarily set the duty frame F every control step. Thus, it is possible to finely control the pump 1 with an easy operation.

Although the DC motor is used as the throttle drive motor 23 of the present invention, a stepping motor or an AC motor may be used. In the stepping motor, the pulse control may be carried out as well as the above mentioned control. Also, in the AC motor, a frequency control may be carried out through using an inverter.

On the other hand, in the system of the present invention, the pump 1 can be also remote-controlled by a controller 3. Namely, as shown in FIGS. 2 and 3 of the present invention, a network is formed by means of connecting a twisted pair line 2 which has little attenuation and suffers little influence of noise, comparing with a parallel type of lead, wherein a distributed type of communication control is carried out between the pump 1 and a plurality of controllers 3. Thus, a multiple remote controls of the pump 1 can be realized.

In the present system, the controller 3 can be appropriately connected or removed at every position of the twisted pair line 2 in such a way as controllers 3*a*-3*d* as shown in FIG. 1. Further, the number of controllers can be increased until the extent of 255 pieces. In addition, as shown in FIG. 1, a connector 7 may be mounted and connected to the controller.

As shown in FIG. 2, the controller 3 has a controller portion 70 comprising a microcomputer, which includes a control circuit 73, a power circuit 74, an operation input circuit 75, display output circuit 76 as well as a main control portion 10. The control circuit 73 is provided with a motion control circuit 71 which controls a key input and a display operation and a communication control circuit 72 which is connected with the twisted pair line 2. Further, the twisted pair line 2 is also connected with the communication control circuit 12 of the main control portion 10. Thus, the both controllers 3 and the pump 1 feed and receive signals through the twisted pair line 2.

In this case, the present system employs a network system called a p-CSMA (p-persistent carrier sense multiple access). Even if the network is situated under a saturated state at a fire spot, the network of the present invention is set to keep a throughput state of signal highly and to restrain a collision rate thereof lowly.

Figure 6:
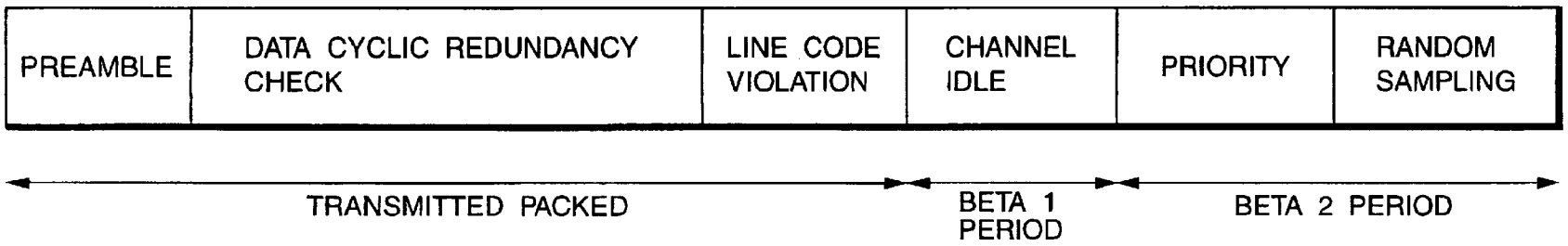
FIG. 6 is an explanatory view showing a construction of a signal in a p-CSMA system.

FIG. 6 shows a construction of signal in the p-CSMA system. Each packed to be transmitted is sent out following a period slot of Beta 1 and some betas 2. Each period of Beta 1 and Beta 2 has an enough width for all the controllers 3 on the network to detect a start of signal transmitting from the other controller 3 and to restrain signal transmitting of itself. In addition, each controller 3 generates a random value from one to sixteen when preparing the transmitting of packed, so that it decides which Beta 2 slot the signals should be transmitted at in the next packed cycle so as to avoid a collision of signal.

Also, the controller 3 is provided with an operation display section 77 which has the operation display panel 18 and the throttle operation key 19 therein. The operation display section 77 is connected with a control circuit 73 through an operation input circuit 75 and a display output circuit 76. When the keys on the operation display panel 18 and the throttle operation key 19 are operated, control signals from the communication control circuit 72 based on the instructions of the motion control circuit 71 are outputted to the pump 1 through the twisted pair line 2. Namely, if, for example, an engine start key 52 of the controller 3*a* is operated, the operation signals are sequentially transmitted to the communication control circuit 72, the twisted pair line 2, and the communication control circuit 12. As a result, according to the instructions of the motion control circuit 11, the cell starter 22 is driven so as to start the engine of the pump 1.

On the other hand, various kinds of data such as the engine speed and the fire-flow pressure and the like from the pump 1 are transmitted to the motion control circuit 71 of each controller 3 through the twisted pair line 2 and then the communication control circuit 72. An operator can display the corresponding data on the operation display panel 18. For example, when the operator selects the display of "engine speed" through operating the display changeover key 55, the motion control circuit 71 selects "engine speed" of data obtained from the pump 1 and outputs it to the display output circuit 76. Thereby, a lamp of "rpm" portion is lighted in the unit display portion 60, and then a numerical value such as "3000" is displayed on the numerical value display portion 58.

In the system of the present invention, all the controllers 3 including the pump 1 have the same relation-ship each other, so that the same operation and display can be carried out in all the controllers 3. Therefore, even when the pump 1 exists away from a fire spot, an operator can control the pump 1 at the most appropriate position on the way between the actual fire spot and the pump 1. Moreover, since the order of priority is not decided in advance in a respective instruction of the controllers 3, a previous instruction has a priority among a plurality of concurrent instructions. However, the order of priority as a content itself of order is decided in advance, that is, an instruction of a safe side always has a priority. For example, in the case that an engine start instruction and an engine stop instruction are issued at the same time or within a predetermined time, the engine stop instruction has a priority, so that the engine does not start.

Thus, the system of the present invention forms the network using the twisted pair line 2 which is cheap and light, resists attenuation and noise well, and easy for laying, wherein the pump 1 is controlled by a communication from the controller 3. Thereby, it becomes possible to carry out a high level of remote control under easier wiring than a conventional one.

Therefore, not only a pump 1 located solely as shown in FIG. 1, but also a pump mounted on a fire truck can be controlled from the controller 3 of the fire spot, with monitoring an operating situation of the pump 1. Namely, although the portable fire pump was explained as an embodiment of the present invention, the present invention can be applied to a various types of pump such as a pump mounted on a vehicle, or a pump installed in a specific place.

Also, although the above description explains a formation in which only the pump 1 supplies water, a plurality of pumps such as pump 1 may be connected as means of "relay water supply". In this case, the main control portion of the most previous pump is the main control portion 10 of FIG. 2, and the following pumps act as the controller. When the pump in each step is set in a mode of "relay water supply", and the water pressure detection sensor 30 detects water pressure over a predetermined value, it automatically carries out a start of engine, a throttle control, and a stop of engine. According to multinotch control of throttle drive motor 23, water pressure and water flow are controlled based on them from the previous pump, and the controlled water is fed to the next pump.

While the invention has been described in conjunction with preferred specific embodiment thereof, it will be understood that this description is intended to illustrate and not limit the scope of the invention, which is defined by the following claims.

What is claimed is:

1. A fire pump control system for controlling a fire pump having an engine, a pump, sensors, and an internal control apparatus, comprising:

at least one external control apparatus located away from the fire pump; and a twisted pair line for connecting said external control apparatus with said internal control apparatus; wherein:

said internal control apparatus and said external control apparatus form a network through said twisted pair line so as to control said fire pump through telecommunications from said external control apparatus;

said internal control apparatus has a control circuit which comprises a motion control circuit for receiving information from said sensors mounted on said fire pump and transmitting control signals to said engine, and said internal control apparatus having a communication control circuit for communicating with said external control apparatus through said twisted pair line; and said external control apparatus has an operation display portion comprising an operation display panel and a throttle operation key for controlling the throttle of said engine.

2. The fire control system according to claim 1, wherein said external control apparatus comprises a control circuit including a communication control circuit for communicating with said internal control apparatus through said twisted pair line.

3. The fire pump control system according to claim 1, wherein:

said operation control panel has a key portion comprising an engine start key, an engine stop key, a motion mode changeover key, and a display changeover key, and has means for displaying an operating state and an abnormality warning for said fire pump.

4. The fire pump control system according to claim 1, wherein said network uses a p-CSMA system for communicating data.

* * * * *

UNITED STATES PATENT AND TRADEMARK OFFICE

CERTIFICATE OF CORRECTION

PATENT NO. : 6,547,528 B1
DATED : April 15, 2003
INVENTOR(S) : Kenichi Yoshida

It is certified that error appears in the above-identified patent and that said Letters Patent is hereby corrected as shown below:

Title page,
Item [30], Foreign Application Priority Data, delete
"Mar. 30, 1999 (JP) ……...11-087669"

Signed and Sealed this

Thirtieth Day of December, 2003

JAMES E. ROGAN
*Director of the United States Patent and Trademark Office*